United States Patent [19]

Nishizawa et al.

[11] Patent Number: 4,984,552

[45] Date of Patent: Jan. 15, 1991

[54] FUEL INJECTION DEVICE FOR AN INTERNAL COMBUSTION ENGINE

[75] Inventors: Hiroyuki Nishizawa, Kyoto; Kimito Kashiwabara, Kameoka; Osamu Nako, Okazaki; Mitsuaki Ishii, Itimeji; Kouichi Yamane, Himeji; Masaaki Miyazaki, Himeji; Ryoji Nishiyama, Amagasaki, all of Japan

[73] Assignees: Mitsubishi Jidosha Kogyo Kabushiki Kaisha; Mitsubishi Denki Ka bushiki Kaisha, both of Tokyo, Japan

[21] Appl. No.: 375,800

[22] Filed: Jul. 5, 1989

[30] Foreign Application Priority Data

Jul. 7, 1988 [JP] Japan ..... 63-169719

[51] Int. Cl.[5] ..... F02D 41/10

[52] U.S. Cl. ..... 123/492

[58] Field of Search ..... 123/492, 422; 364/431.07

[56] References Cited

U.S. PATENT DOCUMENTS 3,858,561 1/1975 Aono ..... 123/492
4,512,318 4/1985 Ito et al. ..... 123/492

FOREIGN PATENT DOCUMENTS 58-133430 8/1983 Japan .
59-176425 10/1984 Japan ..... 123/492
59-200030 11/1984 Japan ..... 123/492
1-92547 4/1989 Japan ..... 123/492

*Primary Examiner*—Andrew M. Dolinar
*Attorney, Agent, or Firm*—Sughrue, Mion, Zinn, Macpeak & Seas

[57] ABSTRACT

A fuel injection device for an automotive internal combustion engine is disclosed, which comprises two distinct acceleration state determining means, i.e., a rapid and a slow acceleration state judgement means, for determining the amount of the asynchronous augmentation of fuel. The rapid acceleration state judgement detects the rapid acceleration state by comparing with a first threshold level the increment of the throttle opening degree over each period of an A/D conversion timing signal; the slow acceleration judgement means, on the other hand, detects the slow acceleration state by comparing with a second threshold level the increment of, for example, the throttle opening degree signal over, for example, two successive periods of the same A/D conversion time signal. When the rapid acceleration state is detected, an asynchronous augmentation of fuel for the rapid acceleration is effected. On the other hand, an asynchronous augmentation of fuel for the slow acceleration is effected only if: (1) the rapid acceleration state is not detected, and (2) the slow acceleration state is detected, over the two successive periods of the timing signal.

6 Claims, 11 Drawing Sheets

FUEL INJECTION DEVICE FOR AN INTERNAL COMBUSTION ENGINE

BACKGROUND OF THE INVENTION

This invention relates to fuel injection devices for spark ignition type internal combustion engines, and more particularly to fuel injection control devices for controlling the amount of fuel to be injected, synchronously and asynchronously with the crank angle signal, into the air inlet passage to the cylinders of internal combustion engines.

Conventionally, the supply of fuel to the spark ignition type internal combustion engines of passenger automobiles has been effected by carburetors; recently, however, fuel injectors are becoming increasingly common. These fuel injectors are capable of supplying a precisely controlled amount of fuel to the internal combustion engine so as to obtain an optimum air-fuel ratio. However, when the engine is in an accelerating transient state, the supply of fuel may be delayed with respect to the increase of the amount of air taken into the engine; this may be occasioned, for example, by: the delay of the detection of the amount of air intake; the delay in the calculation of the amount of fuel to be injected; and the delay resulting from the time which the fuel injected into the air intake pipes of the engine takes to reach the combustion rooms in the cylinders thereof. If the supply of fuel is thus delayed, the air-fuel ratio of the mixture supplied to the engine is deviated from the optimum level.

Thus, the accelerating state of the engine is detected by means of a parameter indicative of the operating state of the engine, so that a trasient accelerating augmentation of fuel is effected in accordance with such detection of the accelerating state of the engine. The acceleration state of the engine may be detected by means of the following state parameters: the opening degree of the throttle valve of the engine; the pressure of the intake air within the air inlet passage taken into the cylinders of the engine; and the amount of the intake air. Since the increment of these state parameters over an interval of time corresponds to the acceleration of the engine, the acceleration state of the engine can be determined by comparing the increment of a state parameter with a predetermined threshold level. The conventional fuel injection device, however, has the following disadvantage:

For the purpose of detecting a rapid acceleration of the engine with a quicker response speed, the interval of time over which the increment of the state parameter is calculated must be made shorter. On the other hand, for the purpose of detecting a slow acceleration of the engine with more enhanced sensitivity, the threshold level must be made lower; this is especially true when the interval of time over which the increment of the state parameter is calculated is short, since the magnitude of the increment during such short interval of time is small. However, the detection signal of the state parameter inevitably containes noises (i.e. small fluctuations of the detection signal which do not correspond to the actual variation of the state parameter); thus, the shorter the interval of time over which the increment is calculated, and the lower the threshold level with which the increment is compared, the more manifest are the adverse effects of the noises contained in the detection signal of the state paramter. Thus, the detection of the rapid acceleration of the engine with a quick response speed and the detection of the slow acceleration with enhanced sensitivity are two contradictory objects which cannot be accomplished simultaneously. Namely, if the rapid acceleration of the engine is to be detected quickly, the interval of time over which the increment is calculated must be made short; further, for the purpose of reducing the adverse efffects of the noises, the threshold level with which the increment is compared must be set high; this results in an inferior sensitivity of the detection of the slow acceleration. On the other hand, if the interval of time over which the increment is calculated is made longer for the purpose of detecting the slow acceleration without adverse effects of the noises, the response to the rapid acceleration becomes slower.

SUMMARY OF THE INVENTION

The primary object of this invention is therefore to provide a fuel injection device for an internal combustion engine which is quick in its response to the transient states of the engine, and, at the same time, which is capable of detecting the slow acceleration of the engine with enhanced sensitivity, so that the air-fuel ratio can be maintained always at the optimum level.

The above object of this invention is accomplished in accordance with the principle of this invention in a fuel injection device for an internal combustion engine which comprises a rapid and a slow acceleration state judgement mean: the rapid acceleration judgement means detects the rapid acceleration state of the engine by comparing with a first threshold level the increment of a state parameter (such as the throttle opening degree) of the engine over each passage of a first (shorter) length of time; the slow acceleration judgment means, on the other hand, detects the slow acceleration state of the engine by comparing with a second threshold level the increment of the state parameter over a second (longer) interval of time. The fuel injection device further comprises, in addition to the main fuel amount determining means for determining the main fuel amount that is to be injected, an augmentative fuel injection amount determining means which determines the augmentative amount of fuel in this manner: when the rapid acceleration state judgement means detects a rapid acceleration state of the engine, it calculates, in response thereto, the augmentative amount of fuel corresponding to the increment of the state parameter over the shorter interval of time; further, it calculates an augmentative amount of fuel corresponding to the increment of the state parameter over the longer length of time when the rapid acceleration state judgement means does not detect the rapid acceleration state of the engine while the slow acceleration judgement means detects the slow acceleration state of the engine.

Thus, according to the principle of this invention, the priority is given to the fuel augmentation in response to the detection of the rapid acceleration state of the engine, and the fuel augmentation in response to the detection of the slow acceleration is effected only when the rapid acceleration of the engine is not detected. Namely, according to the principle of this invention, the interval of time over which increment of the state parameter such as the throttle opening degree is calculated is automatically adjusted to the one of the two length which is best suited to the detection of the rapid or the slow acceleration state of the engine: when the engine is in the rapid acceleration state, the shorter interval of time is selected; when, on the other hand, the engine is in the slow acceleration state, the longer interval of time is selected. Further, the increments of the state parameter over the shorter and the longer length of time, which are calculated when the engine is in the rapid and the slow acceleration state, respectively, are compared with respective threshold levels which can be selected as distinct from each other. Consequently, according to the principle of this invention, the rapid acceleration state of the engine can be detected quickly, while the slow acceleration state with enhanced sensitivity, without adverse effects of the noises contained in the detection signal of the state parameter.

BRIEF DESCRIPTION OF THE DRAWINGS

The novel features which are believed to be characteristic of this invention are set forth with particularity in the appended claims. This invention itself, however, both as to its organization and method of operation, together with further objects and advantages thereof, may best be understood from the following detailed description of the preferred embodiments, taken in conjunction with the accompanying drawings, in which:

FIGS. 5 through 7 are flowcharts showing an example of the steps followed by the fuel injection control device of FIGS. 4*a* and 4*b* according to this invention, wherein FIG. 5 shows the main routine, FIG. 6 an interrupt routine occasioned by a timing signal, and FIG. 7 another interrupt routine occasioned by a crank angle signal.

In the drawings, like reference numerals represent like or corresponding portions.

DETAILED DESCRIPTION OF THE PREFERRED EMBODIMENTS

Figure 1:
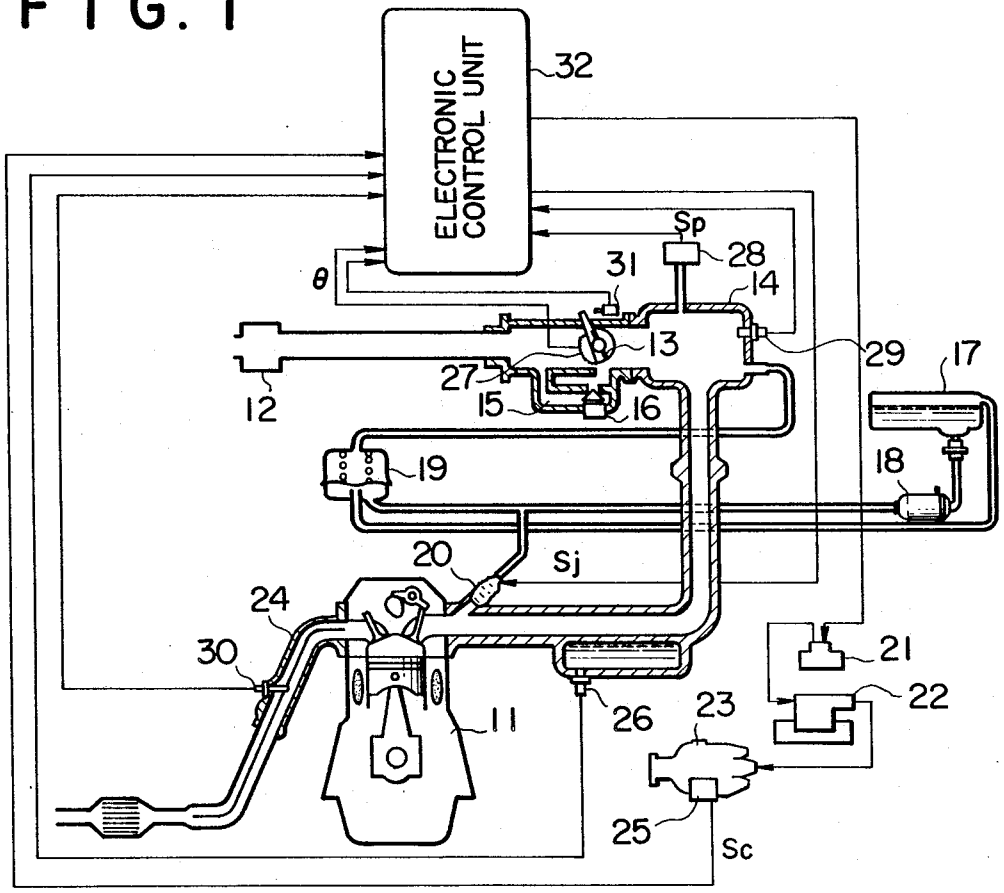
FIG. 1 is a diagramatic view showing the overall structure of an internal combustion engine provided with a fuel injection device according to this invention.

Referring to FIG. 1 of the drawings, let us first describe the overall organization of a spark ignition type internal combustion engine provided with a fuel injector and an electronic control unit according to the present invention; although the following description is made of the case where the engine 11 is a four-cycle three-cylinder engine, the principle of this invention is applicable to any spark ignition type internal combution engines.

When the engine 11 is driven, the air for the combustion is taken into the cylinders of the engine 11 through an air cleaner 12, a throttle valve 13, and a surge tank 14 in this order. During the idling period, however, the throttle valve 13 is closed, and the air for combustion is introduced into the cylinders of the engine 11 via the bypass passage 15 bypassing the throttle valve 13, wherein the opening of the bypass passage 15 is controlled by a thermowax type fast idling valve 16. On the other hand, the fuel (i.e. gasoline) is supplied from the fuel tank 17 by means of a fuel pump 18 through a fuel pressure regulator 19 to fuel injectors 20 disposed in each air intake pipe supplying the air-fuel mixture to the respective cylinders of the engine 11; the injectors 20 inject a controlled amount of fuel simultaneously for all the three cyliners.

Further, the ignition signals are supplied from an ignition driving circuit 21, through an ignition coil 22 and a distributor 23 in this order, to ignition plugs (not shown) disposed in each cylinder of the engine 11. The exhaust gas produced by the combustion in the cylinders of the engine 11 is exhausted into the atmosphere through the exhaust manifold 24, etc.

Figure 3:
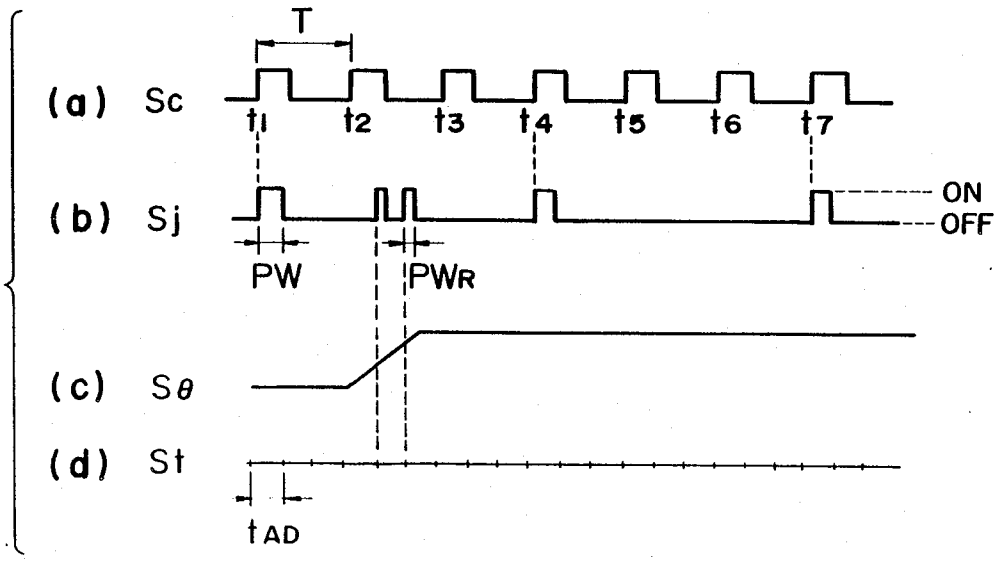
FIG. 3 is a diagram showing the waveforms of the signals generated in the control device of FIGS. 1 and 2.

On the other hand, the sensor system of the engine 11 has the following organization: A crank angle sensor 25 mounted on the distributor 23 detects the numbers of revolutions per minute (rpm) of the crank shaft of the engine 11, and outputs a pulse-shaped crank angle signal Sc whose frequency corresponds to the number of rpm; for example, the crank angle sensor 25 outputs a crank angle signal Sc whose pulses rise at 70 degrees BTDC (before top dead center) and decay at TDC (top dead center). Thus, the crank angle signal Sc has the waveform as shown in FIG. 3 (*a*), whose period T between the leading edges (shown at $t_1$ through $t_7$ in the figure) of two adjacent pulses varies inversely proportionally to the number of rpm, Ne, of the engine 11. Further, a temperature sensor 26 detects the temperature of the coolant water of the engine 11; a throttle opening degree sensor 27 detects the opening degree ($\theta$) of the throttle valve 13; a pressure sensor 28 disposed in the surge tank 14 detects the absolute pressure within the air inlet passage to the engine 11 and outputs a corresponding pressure signal Sp; an intake air temperature sensor 29 disposed at the surge tank 29 detects the intake air teperature; an air/fuel ratio sensor 30 disposed in the exhaust manifold 24 detects the concentration of the oxygen in the exhaust gas, from which the air/fuel ratio is determined; and an idling switch 31 outputs a signal when the throttle valve 13 is closed during an idling period. The signals thus outputted from the above sensors 25 through 30 and the switch 31 are supplied to an electronic control unit (ECU) 32; in response thereto, the electronic control unit 32 determines the amount of fuel to be injected from the injectors 20 according to the principle of this invention, as described below, and outputs an injector driving signal Sj to the fuel injectors 20, by which signal it controls, in accordance with the determined amount of fuel that is to be injected, the length of time during which the valves of the injectors 20 are to be opened. Further, the electronic control unit 32 controls the operation of the ignition driving circuit 21 in a manner well known to those skilled in the art.

Figure 2:
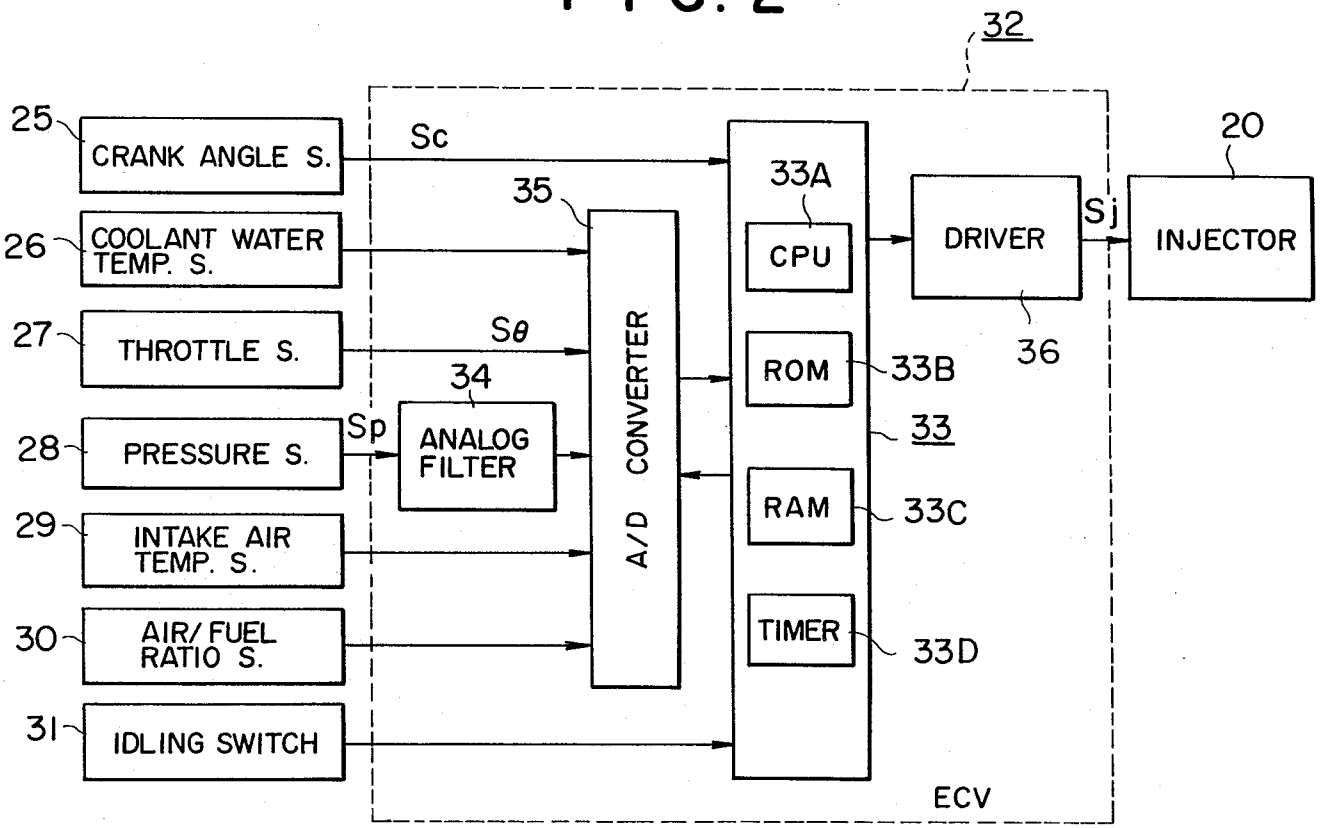
FIG. 2 is a block diagram showing the organization of the electronic control unit for controlling the operation of the engine of FIG. 1.
Figure 5:
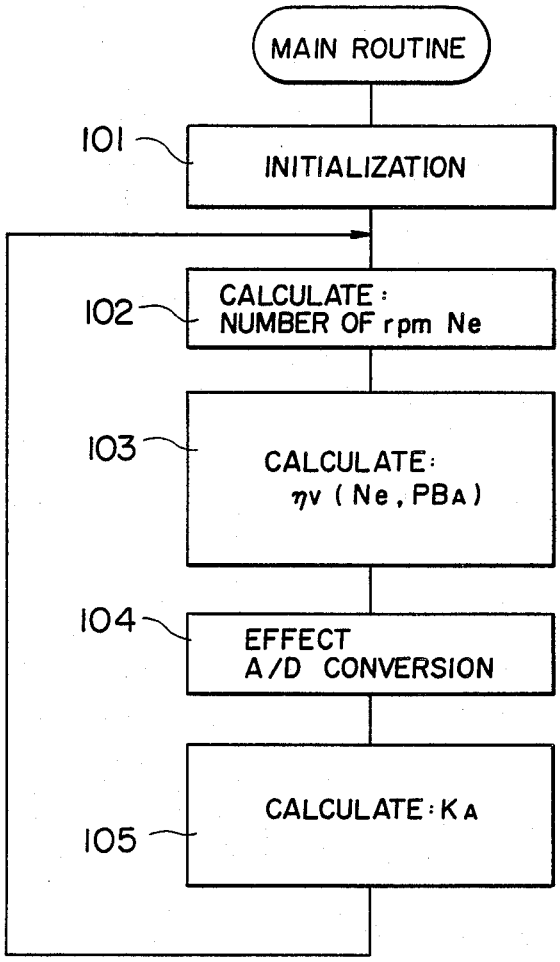
Figure 6A:
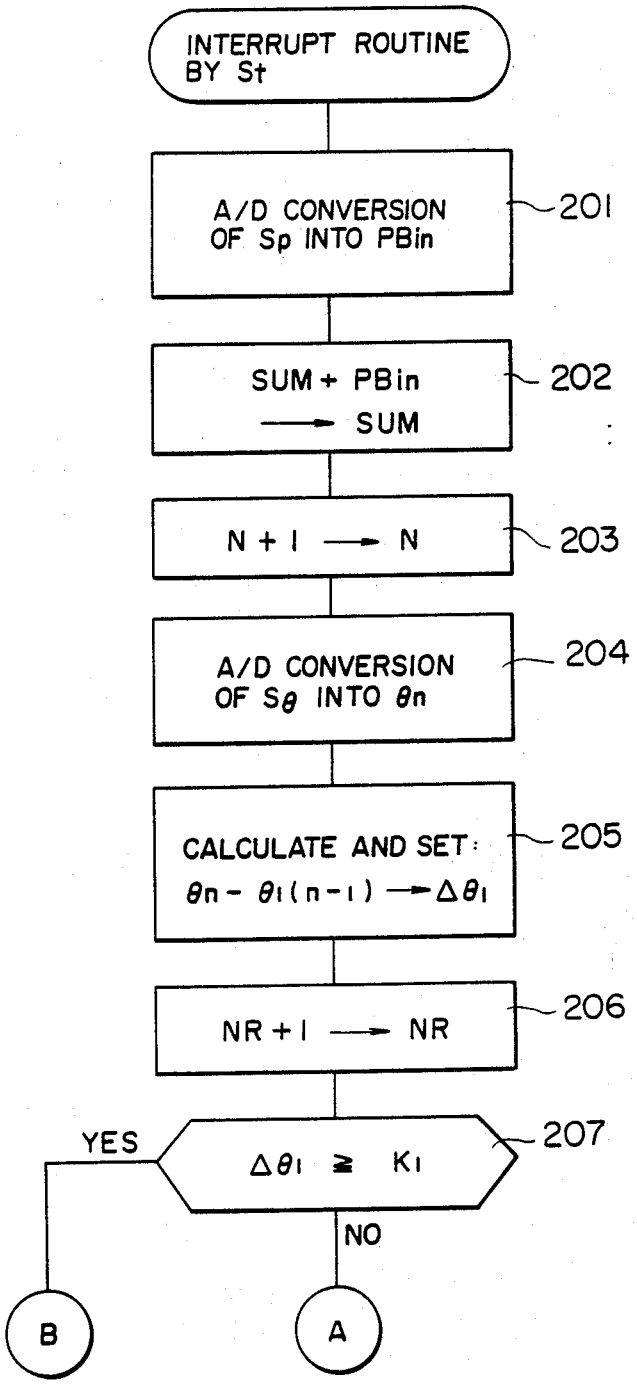
Figure 6B:
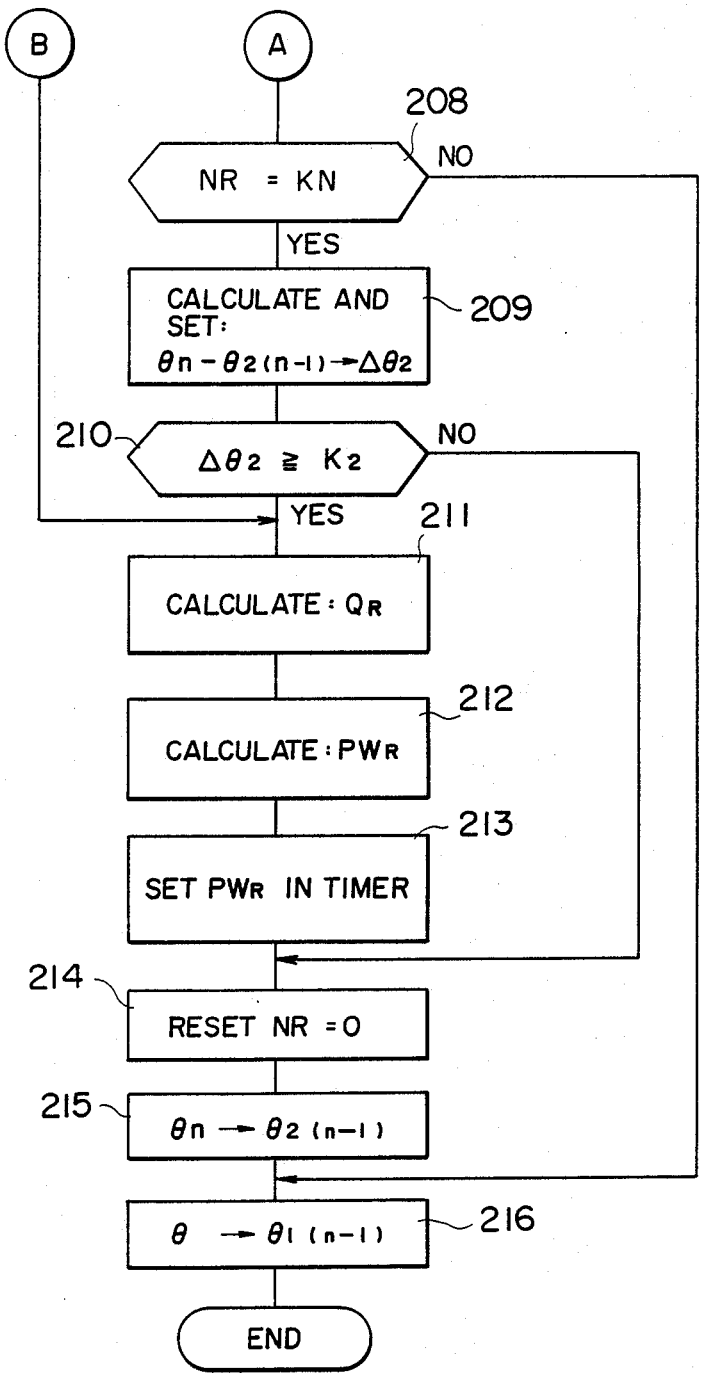
Figure 7A:
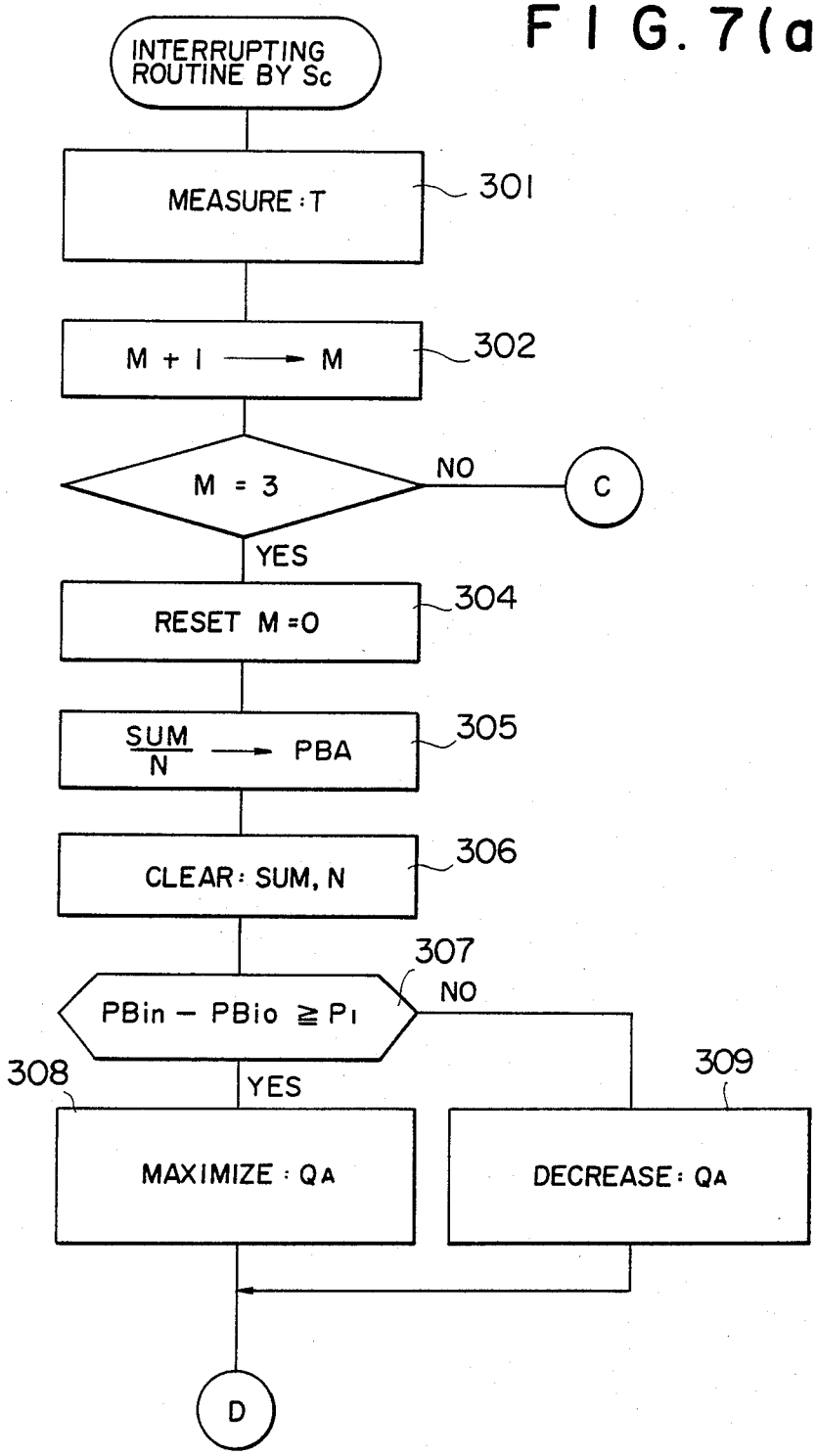
Figure 7B:
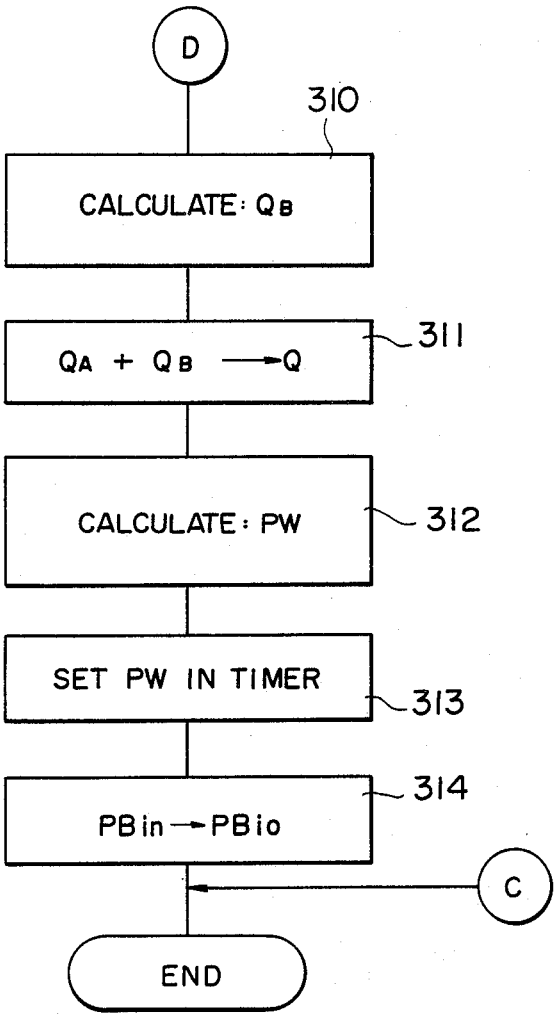

Reffering next to FIG. 2 of the drawings, let us describe the interior organization of the electronic control unit 32 from the view point of the physical implementation thereof. (The functional organization of the control unit 32, especially that of the microcomputer 33, in connection with the principle of this invention, will be described later in reference to FIGS. 4*a* and 4*b*.) As shown in the figure, the control unit 32 comprises a microcomputer 33, an analong filter circuit 34, an A/D converter 35, and a driver circuit 36. The microcomputer 33, which effects various operations and judgements (described in detail hereinbelow in reference to FIGS. 4*a* and 4*b* and FIGS. 5 through 8) according to this invention comprises: a CPU (central processing unit) 33A for executing such operatons and judgements; a ROM (read-only memory) 33B for storing the programs, etc., of such operations and judgements, which programs are illustrated in FIGS. 5 through 7; a RAM (random access memory) 33C functioning as a working memory for storing temporary information such as the data detected by the sensors, etc.; and a timer 33D in which the length of time during which the valves of the injectors 20 are to be opened are set in each fuel injection cycle. The input ports of the microcomputer 33 are coupled to the outputs of the crank angle sensor 25, the idling switch 31, and the A/D converter 35, while the output ports thereof are coupled to the driver circuit 36 and, for the purpose of supplying reference signals, to the A/D converter 35.

The analog filter circuit 34 having an input coupled to the output of the pressure sensor 28 comprises a low pass filter that reduces the ripple contained in the pressure signal Sp outputted from the sensor 28. The A/D converter 35 converts into corresponding digital signals the analog signal outputted from the filter circuit 34 and the analog detection signals outputted from the coolant water temperature sensor 26, the throttle opening degree sensor 27, the intake air temperature sensor 29 and the air/fuel ratio sensor 30. The A/D conversions of the outputs of the throttle opening degree sensor 27 and the analog filter circuit 34 are effected at a predetermined fixed interval $t_{AD}$ (e.g. 2.5 millisseconds), as represented by the A/D conversion timing signal St shown in FIG. 3 (*d*). Thus, the throttle opening degree detection signal S, outputted from the throttle opening sensor 27 is converted into a corresponding digital signal, i.e., the throttle opening degree data $\theta$, at a fixed period $t_{AD}$, a number of times during each fuel injection period; further, the pressure signal Sp outputted from the pressure sensor 28 is, after passing through the analog filter circuit 34, converted into a corresponding digital pressure data PBi by the A/D converter 35 at the same period $t_{AD}$.

On the other hand, the driver circuit 36 outputs, in response to the injection control signal outputted from the microcomputer 33, a pulse-shaped injector driving signal Sj. As shown in FIG. 3 (*b*), the injector driving signal Sj consists of two types of pulses: (1) the synchronous pulses (whose pulse width is represented by PW in the figure) which occur in synchrony with every third pulse of the crank angle signal Sc (which pulse corresponds to every two revolutions of the engine 11, and occurrs at instants $t_1$, $t_4$, and $t_7$ respectively in the figure), for injecting fuel simultaneously for all the three cylinders of the engine 11; and (2) the asynchronous pulses (whose pulse width is represented by $PW_R$ in the figure) which are generated, for injecting an asynchronous augmentative amount of fuel simultaneously for all the three cylinders of the engine 11, during an accelerating transience of the engine 11 during which the throttle opening degree signal S, (see FIG. 3 (*c*)) of the sensor 27 increases relatively rapidly. The methods of determination of the synchronous and the asynchronous pulse widths PW and $PW_R$, and of the occurence or non-occurence of the asynchronous pulses of the injector driving signal Sj are described in detail below in reference to FIGS. 4*a* and 4*b* and FIGS. 5 through 8.

Figure 4A:
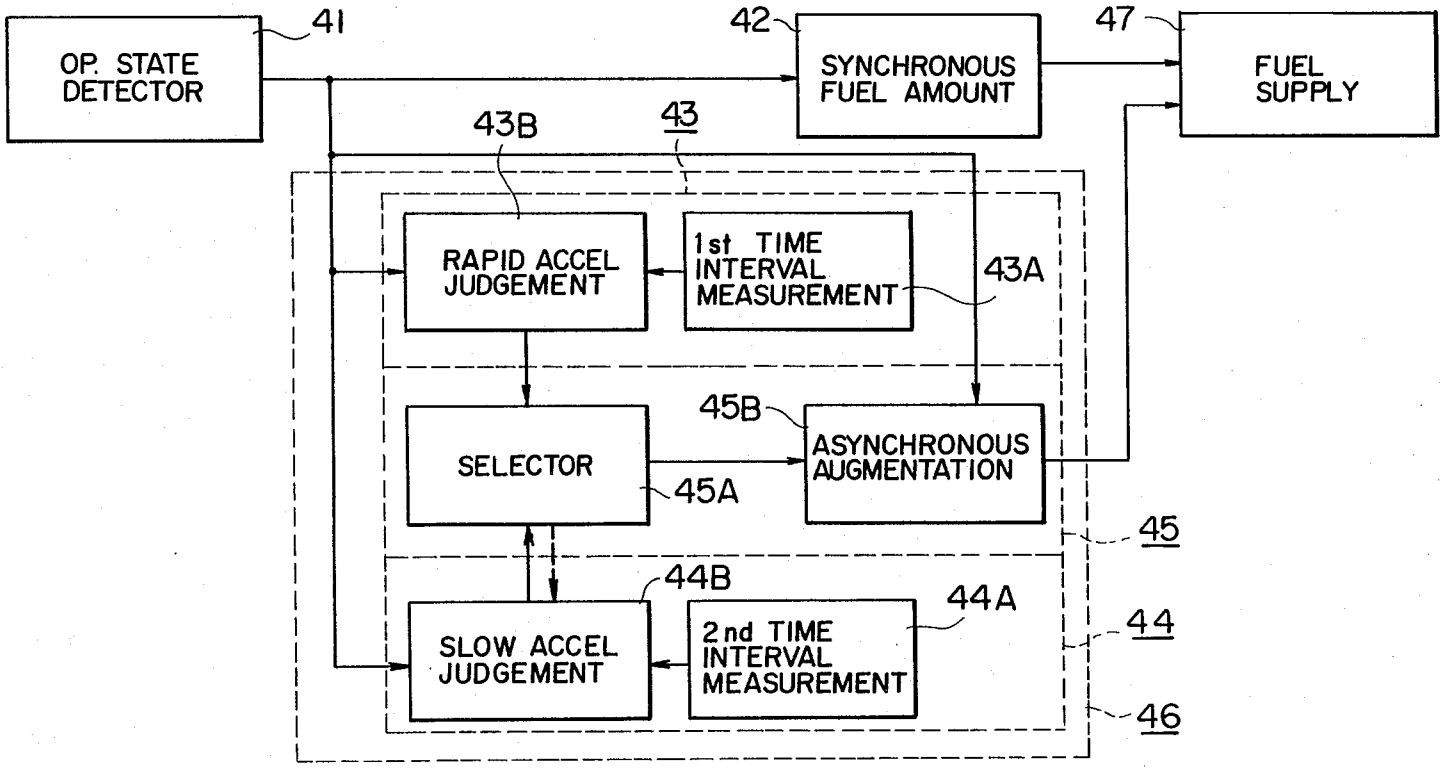
FIG. 4*a* is a block diagram showing the functional organization of the control device for controlling the amount of injected fuel acccording to the principle of this invention.
Figure 4B:
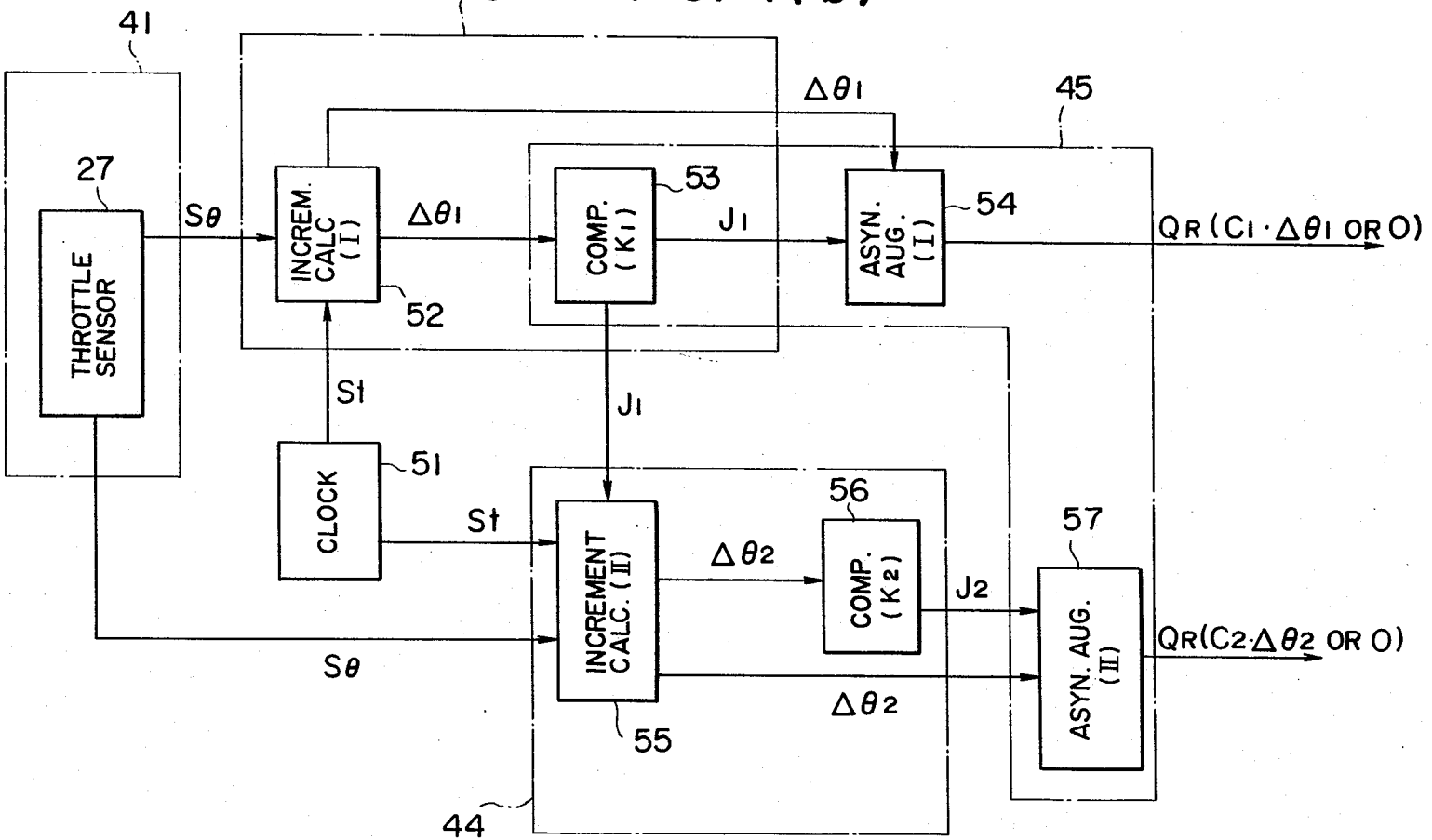
FIG. 4*b* is a block diagram showing a detailed organization of the asynchronous fuel augmentation determining means of the control device of FIG. 4*a*.

Let us now describe the princple of this invention in reference to FIGS. 4*a* and 4*b*, which show schematically the organization of microcomputer 33 and elements associated therewith from the functional point of view.

FIG. 4*a* shows the general principle of this invention. As shown in FIG. 4*a*, the control device according to this invention comprises: operation state detector means 41 (comprising, for example, the throttle opening sensor 27 and the air pressure sensor 28) for detecting a parameter or parameters (such as the throttle opening degree signal S, or the intake air pressure signal Sp, or the throttle opening degree data $\theta$ and the intake air pressure data PBi corresponding thereto) which correspond to the load condition of the engine 11; a main or synchronous fuel amount determining means 42 for determining the main or synchronous fuel amount on the basis of a parameter outputted from the operation state detector means 41; an asynchronous fuel augmentation determining means 46 (comprising a rapid acceleration judgement means 43, a slow acceleration judgement means 44, and an asynchronous augmentation calculation means 45) for determining the amount of asynchronous fuel injection in response to a parameter of the operation state detector 41; and a fuel supply means 47 (comprising the fuel injectors 20) for injecting an amount of fuel determined either by the synchronous or asynchronous fuel amount determining means 42 or 46, to the air intake pipes of the engine 11.

The synchronous fuel amount determining means 42 determines the main or synchronous fuel amount on the basis, for example, of the pressure data PBi corresponding to the pressure signal Sp outputted from the pressure sensor 28; such determination of the synchronous fuel amount may be effected in a manner illustrated in the flowcharts of FIG. 7 (*a*) and (*b*) described hereinbelow; namely:

The average $PB_A$ of the pressure data PBi over each sychronous fuel injection period 3T (see FIG. 3) is calculated; further, the fundamental synchronous fuel amount $Q_B$ is calculated, as is well known to those skilled in the art, on the basis of this averaged pressure data $PB_A$ and the number Ne of revolutions per minute (rpm) of the engine. Further, the variation or increment $\Delta PBi$ of the pressure data PBi over each synchronous fuel injection period 3T is compared with a threshold level $P_1$; in accordance with the result of this comparison, the amount of the syncronous fuel augmentation amount $Q_A$ is calculated. The total amount of synchronous fuel injection Q is obtained as the sum of the fundamental synchronous amount $Q_B$ and the synchronous augumentation $Q_A$:

$$Q=Q_A+Q_B.$$

Thus, the fuel supply means 47 is driven to open the valves of the fuel injectors 20 during an interval of time PW corresponding to the total amount of synchronous fuel injection Q, in synchrony with every third pulse of the crank angle signal Sc, as shown in FIG. 3 (*a*) and (*b*).

On the other hand, the asynchronous augmentation determining means 46, which is characteristic of this invention, determines the amount of asynchronous fuel augmentative injection on the basis, for example, of the throttle opening degree data $\theta$ corresponding to the signal S, outputted from the sensor 27; such determination of the asynchronous fuel augment may be effected as follows:

The rapid acceleration judgement means 43 comprises a first time interval measurement means 43A which measures each passage of a first interval or length of time; the rapid acceleration state judgement means 43B comprised in the means 43 determines the variation or increment of a parameter such as the throttle opening data $\theta$ during each first interval of time, and compares the variation or increment of the parameter with a first predetermined level to detect the rapid acceleration state of the engine 11. On the other hand, the slow acceleration judgement means 44 comprises a second time interval measurement means 44A which measures each passage of a second interval of time that is longer than the first interval of time and may, for example, be an integral multiple of the first interval of time; the slow acceleration state judgement means 44B comprised in the means 44 determines the variation or increment of the parameter such as the throttle opening data $\theta$ over each second (longer) interval of time, and compares the variation or increment of the parameter with a second predetermined level to detect the slow acceleration state of the engine 11. The selector means 45A of the asynchronous augmentation calculation means 45, to which the rapid and slow acceleration signals from the rapid and slow acceleration state judgement means 43A and 44B are inputted, outputs either the rapid or the slow acceleration signal, giving priority to the rapid acceleration signal from the means 43B; the selector means 45A may, as shown by a dotted arrow in the figure, suppress the judgement by the slow acceleration state judqement means 44B when the rapid acceleration signal is inputted thereto from the means 43B. An asynchronous augmentation calculating means 45B determines the amount of the asynchronous fuel augmentation during the acceleration period of the engine 11, on the basis of the output of the selector means 45A and the parameter such as the throttle opening data $\theta$. In this manner, the asynchronous augmentation calculation means 45 calculates the rapid acceleration fuel augmentation on the basis of the parameter from the state detector means 41 when rapid acceleration is detected by the means 43B; it calculates a slow acceleration augmentation on the basis of the same parameter when the means 43B does not detect a rapid acceleration while the means 44B detects a slow acceleration state.

Thus, the fuel supply means 47 is driven to open the valves of the fuel injectors 20 during an interval of time $PW_R$ corresponding to the amount of asynchronous fuel augmentation determined by the asynchronous augmentation determining means 45 when the opening degree of the throttle valve 13 increases relatively quickly, as shown in FIG. 3 (*a*) through (*c*).

FIG. 4*b* illustrates an example of the detailed organization of the asynchronous fuel augmentation determining means 46 of FIG. 4*a* according to the principle of this invention; the correspondence of the two views are indicated in FIG. 4*b* by boxes of dot and dash lines with reference numerals 41 through 45. Let us now describe the principle of this invention in reference to FIG. 4*b*.

The operation state detector means 41 comprises a throttle valve opening degree sensor 27 which detects the opening degree of the throttle valve 13 and outputs the throttle opening degree signal S,. On the other hand, the clock or timer 51 outputs an A/C conversion timing signal St as shown in FIG. 3 (*c*); the pulses of the timing signal St occur at a fixed interval $t_{AD}$, a number of times during each synchronous fuel injection period 3T. The determination of the asynchronous fuel augmentaion $Q_R$ during a rapid acceleration period of the engine 11 is effected by a first increment calculation means 52, a comparator 53, and a rapid asynchronous augmentation calculation means 54: the increment caculation means 52 calculates the increment $\Delta\theta_1$ of the throttle opening degree data $\theta$ (corresponding to the signal $S_1$) over each period $t_{AD}$ of the timing signal St; the comparator 53 compares this increment $\Delta\theta_1$ of the throttle opening degree data outputted from the calculation means 52 with a threshold level K: to determine whether the engine is in a rapid acceleration state or not, whereby the comparator 53 outputs a rapid acceleration detection signal $J_1$ when the above increment is not less than the threshold level $K_1$; in response to the output of the comparator means 53, the rapid asynchronous augmentation calculation means 54 calculates the rapid asynchronous augmentaion $Q_R$ by means of the following equation:

$$Q_R = C_1 \cdot \Delta\theta_1,$$

wherein $C_1$ is a predetermined constant. Thus, the calculation means 54 outputs, in synchrony with each pulse of the timing signal St outputted from the timer 51, an aynchronous augmentation amount $Q_R$ which is given by the above equation when $\Delta\theta_1 \geqq K_1$, and which is otherwise equal to zero (0).

On the other hand, the detection of the slow acceleration state of the engine 11 and the accompanying determination of the asynchronous fuel augmentation during such state of the engine are effected, in response to the output $J_1$ of the comparator 53, by a second increment calculation means 55, a comparator 56, and a slow asynchronous augmentation calculation means 57. The method of operation may be as follows:

The second increment calculation means calculates the increment $\Delta\theta_2$ of the throtle opening degree data $\theta$ during a predetermined number KN (e.g. two) of successive periods of the timing signal St, provided that the output $J_1$ of the comparator 53 is absent during the same successive periods of the timing signal St over which the increment $\Delta\theta_2$ is calculated; namely, the calculation means 55 calculates the increment $\Delta\theta_2$ of the opening degree data $\theta$ during a predetermined number KN of successive periods of the timing signal Sc only under this condition: the increment $\Delta\theta_1$ of the opening degree data in each period $t_{AD}$ of the timing signal St contained in said predetermined number KN of successive periods of the timing signal Sc is less than the threshold level $K_1$.

Figure 8:
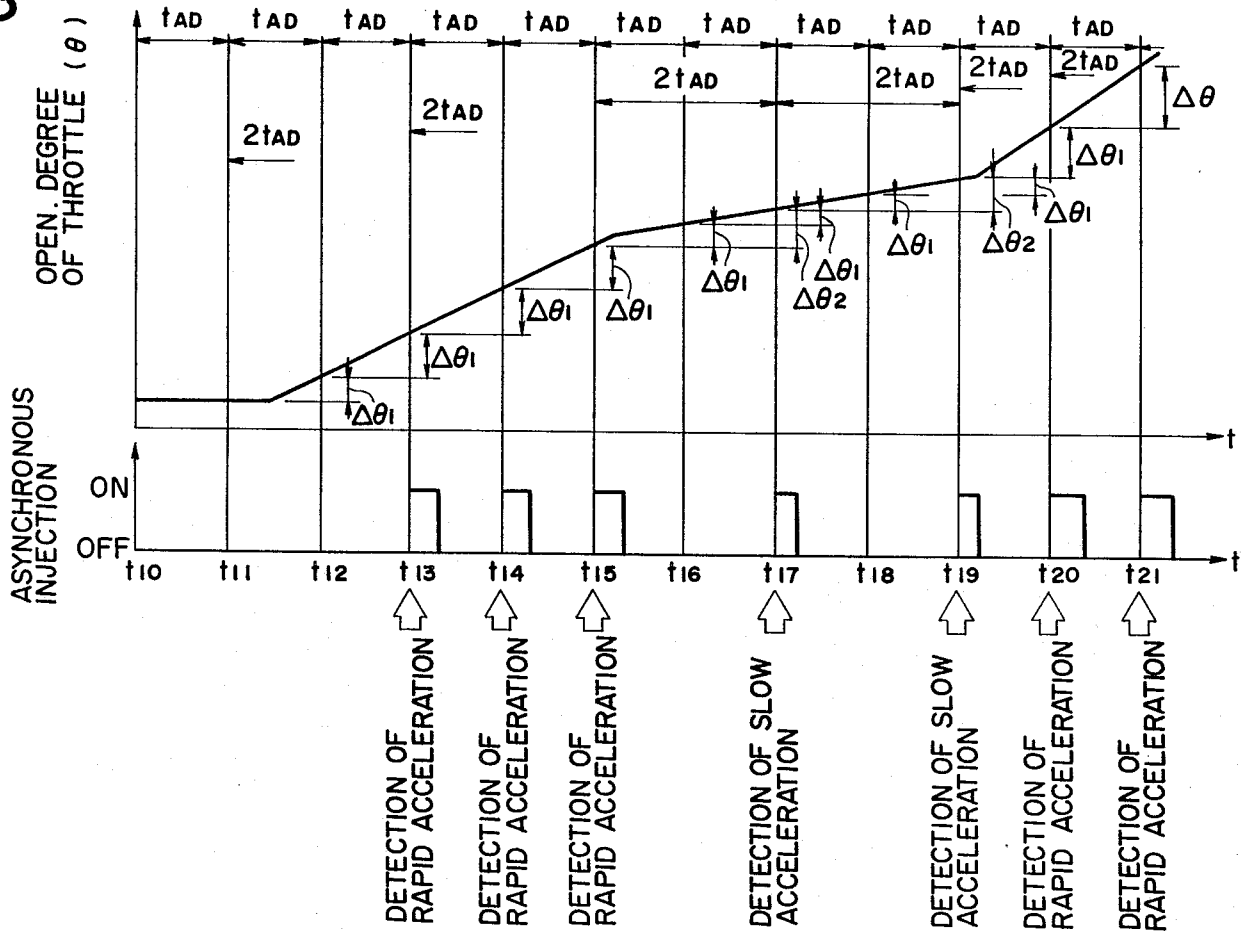
FIG. 8 is a diagram showing the method of operation of the asynchronous fuel amount determining means of FIG. 4*b* according to this invention.

Let us described this operation in reference to FIG. 8 which illustrates the case where the above predetermined number KN of successive periods $t_{AD}$ of the timing signal St is equal to two. Since the increment $\Delta\theta_1$ of the throttle opening degree data during the interval between $t_{11}$ and $t_{12}$, for example, is smaller than the threshold level $K_i$, the comparator 53 does not output the rapid acceleration signal $J_1$ at time point $t_{12}$; however, since the increment $\Delta\theta_1$ between time points $t_{12}$ and $t_{13}$ is not less than the threshold level K1, the comparator 53 outputs the signal $J_1$ at time point $t_{13}$; thus the increment calculation means 55 is reset at time point $t_{13}$ and the calculation of the increment $\Delta\theta_2$ at the same time point $t_{13}$ is supressed. In a like manner, the increment calculation means 55 is reset at time points $t_{14}$, $t_{15}$, $t_{20}$ and $t_{21}$, since the increment $\Delta\theta_1$ during the period $t_{AD}$ preceeding each one of these time points is not less than the threshold level $K_1$. On the other hand, the increments $\Delta\theta_1$ of the opening degree data during the periods $4t_{AD}$ between $t_{15}$ and $t_{19}$ are less than the threshold level $K_1$; thus, the output $J_1$ of the comparator 53 is not generated at these time points, and hence the increments $\Delta\theta_2$ during the two successive periods $2t_{AD}$ of the timing signal St are calculated at time points $t_{17}$ and $t_{19}$.

The comparator 56 compares this increment $\Delta\theta_2$ outputted from the calculation means 55 with a second threshold level $K_2$ to determine whether the enigne is in the slow acceleration state or not; namely, the comparator 56 outputs a signal $J_2$ when $\Delta\theta_2 \geqq K_2$ holds. In response to the output $J_2$ of the comparator 56, the slow acceleration asynchronous augmentation calculation means 57 calculates the amount of asynchronous augmentaion $Q_R$ by means of the following equation:

$$Q_R = C_2 \cdot \Delta\theta_2,$$

wherein $C_2$ is a predetermined constant. Thus, in the case illustrated in FIG. 8, the slow acceleration asynchronous augmentaion calculation means 57 outputs the asynchronous augmentation amount $Q_R$ which is given by the above equation at an end of two successive periods $2t_{AD}$ in each of which the increments $\Delta\theta_1$ is less than the threshold level $K_1$, when the increment $\Delta\theta_2$ during the same period $2t_{AD}$ is greater than the theshold level $K_2$ and hence the signal $J_2$ is outputted from the comparator 56; otherwise, the output of the calculation means 57 remains equal to zero.

Referring now to FIGS. 5 through 7 of the drawings, let us describe the steps which are followed by the device according to the present invention the principle of which is shown in FIGS. 4*a* and 4*b*, whereby reference is also made to FIGS. 2 and 3.

FIG. 5 shows the main routine followed by the CPU 33A in determining the variables utilzed in the calculation of the fundamental amount $Q_B$ of the synchronously injected fuel, etc.; the main routine of FIG. 5 is started when the power source is turned on. At step 101, the data stored in the RAM 33C are cleared to effect the initialization of the various temporary data such as the sensor output data. At the next step 102, the measurement value of the period T of the crank angle signal Sc (refer to FIG. 3 (*a*)) is read out from the RAM 33C to determine the number of rpm, Ne, of the engine 11 by means of the equation: $Ne = 1/T$; the number of rpm Ne thus obtained is stored in RAM 33C. At step 103, the number of rpm Ne and the averaged pressure data $PB_A$ are read out from the RAM 33C, so as to determine the volumetric efficiency $\eta$,(Ne, $PB_A$) on the basis thereof. Namely, the values of volumetric efficiency for attaining a predetermined air-fuel ratio is stored in ROM 33B as a function (i.e. map) of the number of rpm and the pressure data, which function is determined beforehand by an experimental method; thus, the value of the volumetric efficiency $\eta$,(Ne, $PB_A$) corresponding to the pair (Ne, $PB_A$) can be read out from the ROM 33C by the mapping method. The value of the volumetric efficiency thus determined is stored in RAM 33C. Next, the program proceeds to step 104 at which the following detection signals are subjected to A/D conversion via the A/D converter 35, to be stored in RAM 33C: the coolant water temperature signal outputted from the water temperature sensor 26; the intake air temperature signal from the air temperature sensor 29, and the air/fuel ratio signal outputted from the air/fuel ratio sensor 30. Further, at step 105, the sensor detection data relevant to the determinatin of the fundamental amount of injected fuel, i.e. the coolant water temperature data, the intake air temperature data, and the air/fuel ratio data, are read out from the RAM 33C, to determine the composite correction factor $K_A$ which is, as is well known to those skilled in the art, a combination of the correction factors such as: the warming up correction factor corresponding to the coolant water temperature; the intake air temperature correction factor corresponding to the temperature of the intake air; and the feedback correction factor determined on the basis of the air/fuel ratio feedback signal. After the step 105, the program returns to step 102 to repeat the above operations of the main routine.

FIG. 6 (*a*) and (*b*) show an interrupting routine which is occasioned by the timing signal St; at each end of the period $t_{AD}$ of the A/D conversion timing signal St shown in FIG. 3 (*d*), an interrupt signal is generated to start this routine. At step 201, the output signal Sp of the pressure sensor 28 is, after being passed through the analog filter circuit 34, converted into a corresponding digital pressure data PBin by the A/D converter 35. At step 202, the new or current pressure data PBin is added to the accumulating sum of the pressure data, SUM, stored in the RAM 33C to obtain a new updated value of the accumulating sum of the pressure data, SUM; this new updated accumulating sum, SUM, is stored in the RAM 33C together with the current pressure data PBin, so as to update the values thereof stored in the RAM 33C. At the next step 203, unity (1) is added to the number, N, of the times the additions at step 202 that have been effected, so as to obtain an updated number N, which is then stored in the RAM 33C.

Further, at step 204, the output signal S, of the throttle opening degree sensor 27 is subjected to A/D conversion by means of the A/D converter 35 to obtain the new or current throttle opening degree data $\theta n$, which is then stored in the RAM 33C. At step 205, the first increment $\Delta\theta_1$ of the throttle opening degree data $\theta$ is calculated by subtracting the immediately preceeding value $\theta_{1(a-1)}$ of the throttle opening degree data from the current value $\theta n$ thereof:

$$\Delta\theta_1 = \theta n - \theta_{1(a-1)},$$

which is then stored in the RAM 33C. At step 206, unity (1) is added to the number NR for determining the routine execution cycle of the slow acceleration judgement, so as to update the value of NR, which updated value is stored in the RAM 33C. At the step 207, the first increment $\Delta\theta_1$ calculated at the preceeding stgep 205 is compared with a threshold level $K_1$ for determining the rapid acceleration state, which level $K_1$ is set and stored beforehand in the ROM 33B; namely, judgement is made whether $\Delta\theta_1 \geqq K_1$ holds or not. When the judgement at step 207 is affirmative, which means the detection of the rapid acceleration state of the engine, the program proceeds to step 211; when, on the other hand, judgement at step 207 is negative, which means that the engine is not in the rapid acceleration state, the program proceeds to step 208.

At step 208, judgement is made whether the number NR for determining the execution cycle of the slow acceleration state has become equal to a predetermined number KN, which is a predetermined positive integer not less than two; if NR has become equal to KN, the program proceeds to step 209; on the other hand, if NR has not yet reached KN, the program proceeds to step 216. At step 209, a second increment $\Delta\theta_2$ of the throttle opening degree data is calculated by subtracting from the current value $\theta n$ of the opening degree data the preceeding value $\theta_{2(a-1)}$ thereof obtained at step 204 in the execution cycle of the interrupt routine of FIG. 6 effected KN times before the current cycle:

$$\Delta\theta_2=\theta n-\theta_{2(a-1)};$$

as explained below, this value $\theta_{2(a-1)}$ of the throttle opening degree data is the value that has been stored at step 215 in the execution cycle of the routine of FIG. 6 that has been effected KN times before the current execution cycle. At step 210, judgement is made whether or not the second increment $\Delta\theta_2$ of the throttle opening degree data is above a threshold level $K_2$ for the slow acceleration judgement; namely, judgement is made whether $$\Delta\theta_2 \geqq K_2$$

holds or not. If the judgement at step 210 is affirmative, it is determined that the engine is in a slow acceleration state, and the program proceeds to step 211; on the other hand, if the judgement at step 210 is negative, the engine is judged to be in a stable state, and the program proceeds to step 214.

Steps 211 through 213 are executed to effect asynchronous injection of fuel when either a rapid or a slow acceleration state of the engine is detected at step 207 or 210. Namely, at step 211, the amount of asynchronous fuel augmentation $Q_R$ is calculated on the basis of the first increment $\Delta\theta_1$ (in the case where the rapid acceleration state of the engine has been detected at the preceeding step 207) or the second increment $\Delta\theta_2$ (in the case where the slow acceleration state has been detected at the preceeding step 210); more specifically, the asynchronous fuel augmentation amount $Q_R$ is calculated by:

$$Q_R=C_1\cdot\Delta\theta_1,$$

or $$Q_R=C_2\cdot\Delta\theta_2,$$

wherein $C_1$ and $C_2$ are predetermined constants stored in the ROM 33B. Further, at step 212, the fuel to driving time conversion factor $K_{INJ}$ and the dead time $T_D$ of the injectors 20 are read out from the ROM 33B, and the asynchronous driving time length $PW_R$ of the injectors 20 is calculated by the following equation:

$$PW_R=Q_R\times K_{INJ}+T_D.$$

Thus, at step 213, the asynchronous driving time $PW_R$ of the injectors 20 is set in the timer 33D, so as to operate it for the time length $PW_R$; in response to the output of the timer 33D, the driver circuit 36 outputs to the injectors 20 a corresponding pulse of the injector driving signal Sj whose width is equal to $PW_R$. As a result, the injectors 20 injects an aynshronous augmentation fuel amount corresponding to $Q_R$ in asynchrony with the pulses of the crank angle signal Sc.

At step 214, the number NR for determining the execution cycle of the slow acceleration state is reset to zero (0). Further, at step 215, the current value $\theta n$ of the throttle opening degree data is set and stored in the RAM 33C as the updated value $\theta_{2(a-1)}$ of the throttle opening degree data which is to be used in the calculation of the second increment $\Delta\theta_2$ at step 209 in the KNth execution cycle of the routine of FIG. 6 after the current execution cycle of the routine. Further, at the final step 216 which concludes the interrupt routine of FIG. 6, the current value $\theta n$ of the throttle opening degree data is set and stored in the RAM 33C as the updated value of $\theta_{1(a-1)}$ which is to be used at steps 205 and 209, etc., in the next execution cycle of the interrupt routine of FIG. 6.

Referring next to FIG. 7 of the drawings, let us describe an interrupting routine for calculating the amount of fuel injected in synchrony with the crank angle signal Sc; each time a pulse of the crank angle signal Sc rises, a crank angle interrupt signal is generated to start this interrupting routine.

At step 301, the measurement value of the period T of the crank angle signal Sc is stored in the RAM 33C; this period T may be determined by a timer consisting of either a software or a hardware within the microcomputer 33. At step 302, unity (1) is added to the number of occurences, M, of the pulses of the crank angle signal Sc, to update the value of M. At step 303, judgment is made whether the number of occurences M of the pulses of the crank angle signal Sc is equal to three or not; if it has not yet reached three, the current value of M is stored in the RAM 33C to end the routine of FIG. 7 at step 303. If, on the other hand, the judgement at step 303 is affirmative (i.e. M=3), the value of M stored in the RAM 33C is reset to zero (0) at the subsequent step 304, and the program proceeds to step 305. Thus, the following steps 305 through 314 are performed at each third pulse of the crank angle signal Sc to effect a synchronous fuel injection.

At step 305, the average PB. of the pressure data PBin over the preceeding fuel injection period (which is equal to 3T as shown in FIG. 3 (*a*) and (*b*)) is obtained by dividing the accumulating sum of the pressure data SUM (which has been updated and stored in the RAM 33C at the immediately preceeding step 202) by the number of additions N (which has been updated and stored at the immediately preceeding step 203):

$$PB_A=SUM/N.$$

At the next step 306, the value of the sum of the pressure data SUM and the number of additions N stored in the RAM 33C are cleared to zero (0). At step 307, the increment of the pressure data PBi during the preceeding synchronous fuel injection period 3T, namely:

$$\Delta PBi=PBin-PBio$$

is compared with a threshold level $P_1$, so as to determine whether $$\Delta PBin \geqq P_1$$

holds or not; wherein PBin is the current value of the pressure data which has been obtained at the immediately preceeding step 201 (this current value PBin is the value of the pressure data that is obtained immediately before the current fuel injection, i.e. immediately before the leading edge of the pulse of the crank angle signal Sc that is synchronized with the current injection of fuel), and PBio is the value of the pressure data that was obtained immediately before the preceeding fuel injection, i.e. immediately before the leading edge of the pulse of the crank angle signal Sc that was synchronized with the preceeding fuel injection. If the increment $\Delta PBi$ is not less than the threshold level $P_1$, namely:

$$\Delta PBi \geqq P_1,$$

then, the program proceeds to step 308; on the other hand, if the increment $\Delta PBi$ is less than the threshold level, the program proceeds to step 309.

At step 308, the transient synchronous augmentation $Q_A$ of the amount of injected fuel is maximized; more specifically, a candidate value $Q_{A1}$ of the transient synchronous augementation is calculated by multiplying the variation or increment ΔPBi by a predetermined constant k:

$$Q_{A1}=k\cdot\Delta PBi,$$

and this candidiate value $Q_{A1}$ is compared with the previous value $Q_{A0}$ of the transient synchronous augmentation which is stored in the RAM 33C, so as to select the larger one of the two values $Q_{A1}$ and $Q_{A0}$ as the new maximized value $Q_A$ of the transient synchronous augementation; this new maximized value of the transient augmentation $Q_A$ is stored in the RAM 33C. Incidentally, if preferred, the above candidate value $Q_{A1}$ may be used as the current (maximized) value of the transient increase $Q_A$ without comparing it with the previous value of the transient increase. On the other hand, the transient synchronous augmentation $Q_A$ is decreased at step 309; namely, the new decreased value of $Q_A$ is obtained by subtracting a predetermined constant $\theta$ from the previous value of the transient synchronous augmentation, $Q_{A0}$, stored in the RAM 33C:

$$Q_A=Q_{A0-\theta};$$

when, however, the result of the above subtraction is negative, the new decreased value of $Q_A$ is clipped to zero. After the respective steps 308 and 309, the program proceeds to step 310.

At step 310, the correction factor $K_A$, the volumetric efficiency $\theta\eta$(Ne, $PB_A$), and the averaged pressure data $PB_A$ calculated at steps 105, 103, and 305 respectively, are read out from the RAM 33C; further the pressure-fuel conversion factor $K_Q$ is read out from the ROM 33B, so as to compute the fundamental amount of the synchronously injected fuel $Q_B$ by means of the equation:

$$Q_B=K_Q\times K_A\times\theta\eta(Ne,\ PB_A)\times PB_A.$$

At the next step 311, the amount of fuel Q that is to be injected synchronously is calculated by adding the transient synchronous augmentation $Q_A$ to the fundamental synchronous amount $Q_B$:

$$Q=Q_A+Q_B.$$

Further, at step 312, the length of time PW during which the injector 20 is driven is calculated. Namely, the fuel to driving time conversion factor $K_{INJ}$ and dead time $T_D$ are read out from the ROM 33B to compute the synchronous driving time PW by the equation:

$$PW=Q\times K_{INJ}+T_D.$$

At step 313, the injector driving time PW is set in the timer 33D, which is thus put into operation for the time length PW; during the time PW in which the timer 33D is operating, the pulse-shaped injector driving signal Sj is applied to the injector 20 via the driving circuit 36, so that the amount of fuel corresponding to the amount Q is injected into the air inlet to the engine 11. At the final step 314, the current pressure data PBin obtainend immediately before the current fuel injection is stored in the RAM 33C as the value of PBio which is to be used at step 307 in determining the increment of the pressure data at the next fuel injection cycle.

The diagram of FIG. 8 showing the method of operation of the asynchronous augmentation determining means 46 of FIGS. 4*a* and 4*b*, which has already been described briefly above, may now be comprehended more fully and clearly. FIG. 8 corresponds to the case where the predetermined number KN utilized in the routine of FIG. 6 is equal to two; the interrupt routine of FIG. 6 is started by each pulse of the timing signal St (see FIG. 3) at time points $t_{10}$ ° through $t_{21}$ which are separated from each other by a fixed period $t_{AD}$. Let us assume that the throttle opening degree data $\theta$ increases as shown by the solid curve in the figure. Then, in the execution cycle of the interrupt routine of FIG. 6 at time points $t_{13}$ through $t_{15}$, $t_{20}$, and $t_{21}$, the first increment $\Delta\theta_1$ of the throttle opening degree (determined at step 205 of each execution cycle of the routine) is not less than the threshold level $K_1$ for determining the rapid acceleration; thus, the rapid acceleration state of the engine is detected at step 207 in each execution cycle of the rountine of FIG. 6, and an asynchronous injection of fuel (indicated by an arrow at X) is effected accordingly at each one of these time points, via the execution of the steps 211 through 213 thereof; thus, in the execution cycle of the routine of FIG. 6 at these time points $t_{13}$ through $t_{15}$, $t_{20}$ and $t_{21}$, the steps 208 through 210, in particular the slow acceleration judgement at step 210, are not effected; further the number NR for determining the slow acceleration judgement cycle is reset to zero (0) at step 214, and the current value $\theta n$ of the throttle opening degree data is set and stored at step 215 as the updated value of the throttle opening degree data $\theta_{2(a-1)}$ for calculating the second increment $\Delta\theta_2$.

On the other hand, in the execution of the routine of FIG. 6 at time point $t_{16}$, the first increment $\Delta\theta_1$ is less than the threshold level $K_1$ at step 207; however, since the value of the number NR updated at step 206 is equal to unity (1) and does not yet reach KN=2. Thus, the judgement at step 208 is negative, and the steps 209 through 215, and in particular the slow acceleration judgement at step 210, are not performed. However, in the execution of the routine of FIG. 6 at the next time point $t_{17}$, the following two conditions are satisfied: first, the first increment $\Delta\theta_1$ is less than the threshold level $K_1$ at step 207; and second, the value of the number NR updated at step 206 is now equal to KN=2. Consequently, the slow acceleration judgement is effected at steps 209 and 210, and since the second increment $\Delta\theta 2$ is not less than the threshold level $K_2$ at step 210, a slow acceleration state of the engine is detected as indicated by an arrow at Y, and an aynchronous injection of fuel is effected by the injectors 20 at the time point $t_{17}$ accordingly. Processes which are similar to the above are repeated at time points $t_{18}$ and $t_{19}$ as is evident from the figure; thus, a slow acceleration state of the engine is detected at time point $t_{19}$ and an asynchronous fuel injection is effected by the injectors 20 accordingly, as indicated by another arrow at Y.

On the other hand, at the time points $t_{10}$, $T_{11}$, and $t_{12}$, neither the rapid nor the slow acceleration state of the engine is detected. Incidentally, if the value of the number NR updated at step 206 had been equal to KN=2 at time point $t_{12}$, then the slow acceleration judgement would have been effected at the same time point; the figure shows the case where the value of the number NR is still equal to unity at time point $t_{12}$, so that the second increment $\Delta\theta_2$ is not calculated at the same time point.

While description has been made of the particular embodiments of this invention, it will be understood that many modifications may be made without departing from the spirit thereof; for example, in the above embodiment, the rapid and slow acceleration state of the engine is determined on the basis of the throttle opening degree data $\theta$; however, they may be determined on the basis of the pressure data PBi obtained from the output of the intake air pressure sensor or on the basis of the output signal of an air flow sensor which is disposed in the air intake pipe to detect the amount of air intake to the engine. The appended claims are contemplated to cover any such modifications as fall within the true spirit and scope of this invention.

What is claimed is:

1. A fuel injection device for injecting a controlled amount of fuel to a cylinder of a spark ignition type internal combustion engine, said fuel injection device comprising:

operation state detector means for detecting an operations state of the internal combustion engine, said operation state detector means outputting at least one state parameter corresponding to the operation state of the internal combustion engine;

main fuel amount determining means, coupled to said operation state detector means, for determining, in accordance with a state parameter outputted from the operation state detector means, a main amount of fuel which is to be injected by the injection device;

first increment calculation means, coupled to an output of said operation state detector means, for calculating a first increment of a state parameter outputted from said operation state detector means, over each passage of a first length of time;

rapid acceleration state judgement means, coupled to said first increment calculation means, for detecting a rapid acceleration state of the internal combustion engine, wherein said rapid acceleration state judgement means compares said first increment of the state parameter with a first threshold level to detect the rapid acceleration state of the internal combustion engine;

second increment calculation means, coupled to an output of said operation state detector means, for calculating a second increment of said state parameter outputted from said operation state detector means, over each passage of a second length of time which is longer than said first length of time;

slow acceleration state judgement means, coupled to said second increment calculation means, for detecting a slow acceleration state of the internal combustion engine, wherein said slow acceleration state judgement means compares said second increment of the state parameter with a second threshold level to detect the slow acceleration state of the internal combustion engine;

augmentative fuel amount determining means, coupled to said first and second increment calculation means and said rapid and slow acceleration state judgement means, for calculating an augmentative amount of fuel, wherein said augmentative fuel amount determining means calculates an augmentative amount of fuel corresponding to said first increment of the state parameter when said rapid acceleration state judgement means detects the rapid acceleration state of the internal combustion engine, and calculates an augmentative amount of fuel corresponding to said second increment of the state parameter when the rapid acceleration state judgement means does not detect the rapid acceleration state of the internal combustion engine while the slow acceleration state judgement means detects the slow acceleration state of the internal combustion engine; and fuel injector means, coupled to said main and augmentative fuel amount determining means, for injecting fuel to the internal combustion engine, an amount of injected fuel corresponding to the main amount of fuel determined by the main fuel amount determining means, or to the augmentative amount of fuel determined by the augmentative fuel amount determining means.

2. A fuel injection device as claimed in claim 1, wherein:

said operation state detector means comprises intake air pressure sensor means for detecting an intake air pressure of the internal combustion engine, and throttle opening degree sensor means for detecting an opening degree of a throttle valve of the internal combustion engine, the operation state detector means outputting the detected intake air pressure and the detected throttle opening degree as state parameters corresponding to the operation state of the internal combustion engine;

said main fuel amount determining means determines the main amount of fuel in accordance with the intake air pressure detected by said intake air pressure sensor means; and said first and second increment calculation means calculate the first and the second increment of said throttle opening degree detected by said throttle opening degree sensor means, respectively, wherein said augmentative fuel amounts determining means determines the augmentative fuel amount corresponding to the first and second increments of the throttle opening degree, respectively.

3. A fuel injection device as claimed in claim 2, wherein said rapid and slow acceleration state judgement means detect the rapid and the slow acceleration states of the internal combustion engine, respectively, when the throttle opening degree is not less than the first and the second threshold level, respectively.

4. A fuel injection device as claimed in claim 1 or 2, further comprising:

crank angle sensor means for detecting a predetermined angle of a crank shaft of the internal combustion engine, said crank angle sensor means outputting a crank angle signal corresponding to the predetermined angle of the crank shaft; and timer means for outputting a timing signal at a predetermined fixed period;

wherein said main fuel amount determining means determines the main amount of fuel which is to be injected by the injection device in synchrony with the crank angle signal; said first increment calculation means calculates the first increment of the state parameter over each period of the timing signal of the timer means; and said second increment calculation means calculates the second increment of the state parameter over a predetermined number of successive periods of the timing signal of the timer means.

5. A fuel injection device as claimed in claim 4, wherein said second increment calculation means is coupled to an output of said rapid acceleration state judgement means, and, when said rapid acceleration state judgement means detects a rapid acceleration state of the internal combustion engine, the calculation of the second increment of the state parameter by said second increment calculation means is suppressed.

6. A fuel injection device as claimed in claim 4, wherein aid predetermined number of successive periods of the timing signal of the timer means over which the second increment of the state parameter is calculated is equal to two.

* * * * *